US005558453A

United States Patent [19]

Bell et al.

[11] Patent Number: 5,558,453

[45] Date of Patent: Sep. 24, 1996

[54] CONTAINER AND APPLICATOR COMBINATION

[75] Inventors: Ronald F. Bell, Uniontown, Ohio; Charles W. Botsford, Highland Village, Tex.; Thomas Kearnes, Richfield; Detlev F. Smith, Akron, both of Ohio

[73] Assignee: GOJO Industries, Inc., Cuyahoga Falls, Ohio

[21] Appl. No.: 443,426

[22] Filed: May 18, 1995

[51] Int. Cl.[6] ..... A46B 11/00

[52] U.S. Cl. ..... 401/137; 401/139

[58] Field of Search ..... 401/137, 139

[56] References Cited

U.S. PATENT DOCUMENTS

| | | | |
|---|---|---|---|
| 1,468,671 | 9/1923 | Pasini | 401/139 X |
| 1,679,843 | 8/1928 | Traube | 401/139 |
| 2,828,500 | 4/1958 | Peacock | 401/137 |
| 2,886,839 | 5/1959 | Leopoldi | 401/139 |
| 2,986,762 | 6/1961 | Webb | 401/139 X |
| 3,008,164 | 11/1961 | Herman et al. | 401/139 X |
| 3,031,711 | 5/1962 | Herman et al. | 401/139 X |
| 3,544,226 | 12/1970 | Kellis | 401/137 |
| 3,565,541 | 2/1971 | Vallis | 401/137 |
| 4,778,301 | 10/1988 | Sicotte | 401/137 X |

*Primary Examiner*—Steven A. Bratlie
*Attorney, Agent, or Firm*—Reese Taylor

[57] ABSTRACT

A container and applicator combination includes a container for a product and an applicator for the product. The container has at least one pair of engagement grooves disposed so as to receive and engage the applicator which is thus releasably attached to the container. The applicator has a handle base and projecting, container engaging legs which can be snapped into releasable engagement with the engagement grooves in the container and is configured substantially complemental to at least a portion of the container configuration.

7 Claims, 3 Drawing Sheets

CONTAINER AND APPLICATOR COMBINATION

BACKGROUND OF THE INVENTION

This invention relates in general to containers for soap or similar cleaning products and relates in particular to a combination of a container and applicator which is releasably attachable to the container.

DESCRIPTION OF THE PRIOR ART

It has long been known that soap and other cleaning materials can be sold and marketed in containers having removable caps. These containers sometimes have pumps incorporated in the neck or spout area for product dispensing; sometimes are squeeze bottles having flip open tops and sometimes simply dispense the material by tilting and pouring after removal of the cap.

It has similarly long been known that soap or other cleaning materials, such as, for example, those intended for use on human skin, can be applied and their efficacy improved by the utilization of brushes or similar applicators or cleansing aids.

It is, therefore, apparent that it is often desirable for the end user to possess both the container containing the soap or other cleaning agent, and a brush, and it is also believed desirable to make it possible to market these articles as a combination without detracting from the desirable aesthetic appearance of the product. In that regard it is well known that the marketing of products of this type, particularly on the retail level, is enhanced by providing an attractive-looking and eye-catching package.

In the prior art brushes or other applicators have been marketed with containers. Generally, this is accomplished by shrink-wrapping the brush onto the exterior of a container with a film. The result is often a somewhat unsightly combination. Additionally, it is sometimes somewhat difficult to remove the shrink-wrapping to obtain access to the applicator or brush. Finally, once the shrink-wrapping is removed, the brush and container have a tendency to become separated over a period of time so that the desirable object of having the two components for the cleaning operation readily available in one place is defeated.

Additionally, the shrink-wrapping presents manufacturing complexities and adds to the overall cost of the combined products.

Accordingly, it is believed desirable to provide a combination container and applicator which makes it probable that the brush will remain with the container in use; that enhances the value to the purchaser and that presents pleasing aesthetics while retaining the utilitarian advantage of maintaining them, more or less, as a unit.

SUMMARY OF THE INVENTION

It is accordingly a principal object of this invention to provide a container and applicator combination wherein the applicator can be readily attached to the container and readily removed therefrom without any additional manufacturing steps while achieving the aesthetic advantages of an attractive overall package and the functional advantages of the brush and container usable together.

It has been discovered that this object can be achieved by providing the typical container with applicator receiving depressions along the front and rear surfaces thereof adjacent the connecting sidewalls of the container. In that regard, one or more pairs may be employed.

It has further been found that the brush can be provided with a base and normally extending edges which terminate in flanges capable of engaging the depressions in the body of the container whereby the brush may be easily attached to and removed from the container.

It is has further been found that the object above-defined can be achieved by providing that the base and edges of the applicator can be shaped so as to substantially complement the configuration of the container thereby presenting a pleasing aesthetic effect when assembled.

These and other objects of the invention will become more apparent upon a reading of the following brief specification considered and interpreted in view of the accompanying drawings.

BRIEF DESCRIPTION OF THE PREFERRED EMBODIMENTS

Figure 1:
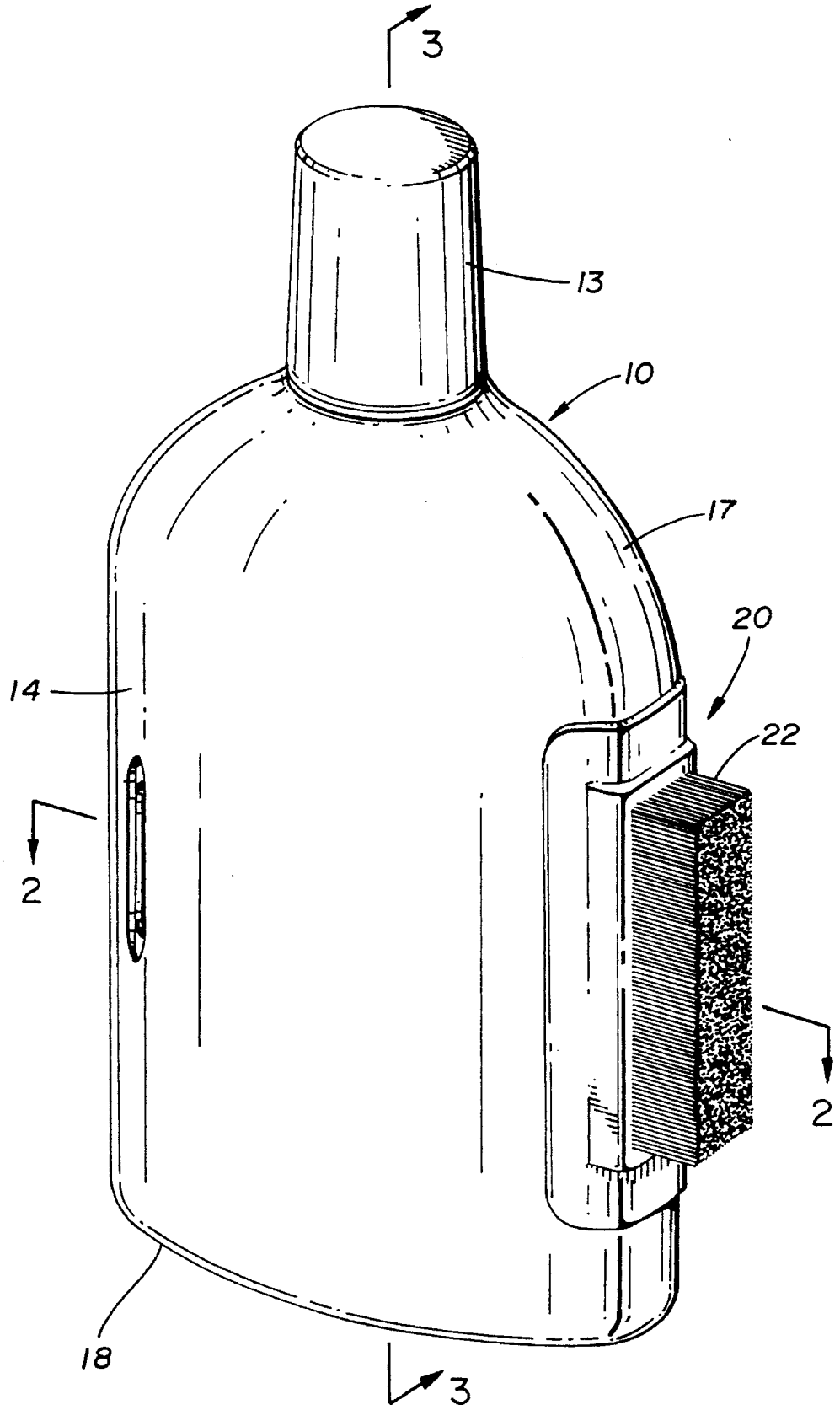
FIG. 1 is a perspective view of the improved container and applicator combination.
Figure 2:
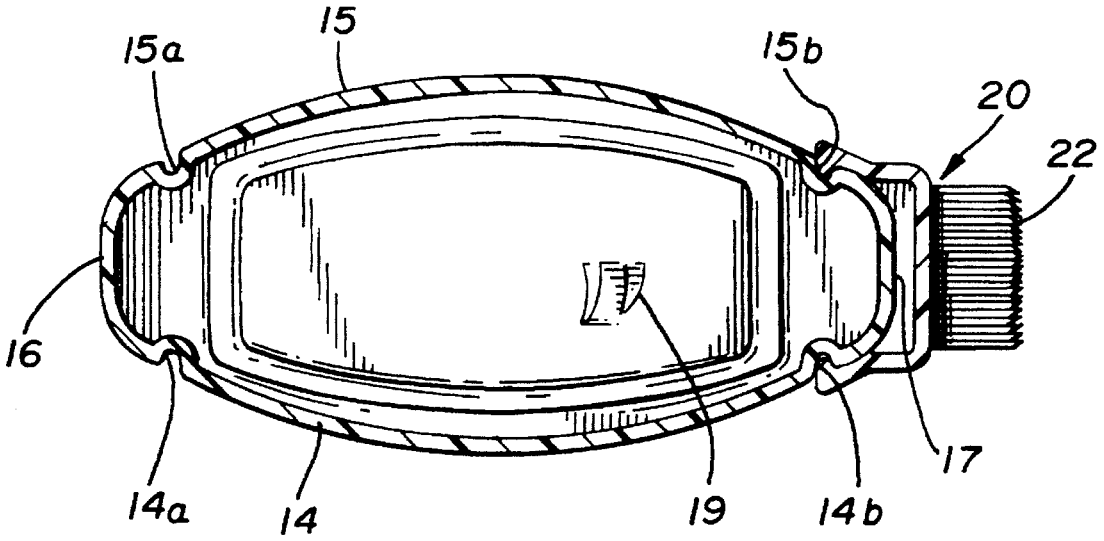
FIG. 2 is a sectional view thereof taken along the line 2—2 of FIG. 1.
Figure 3:
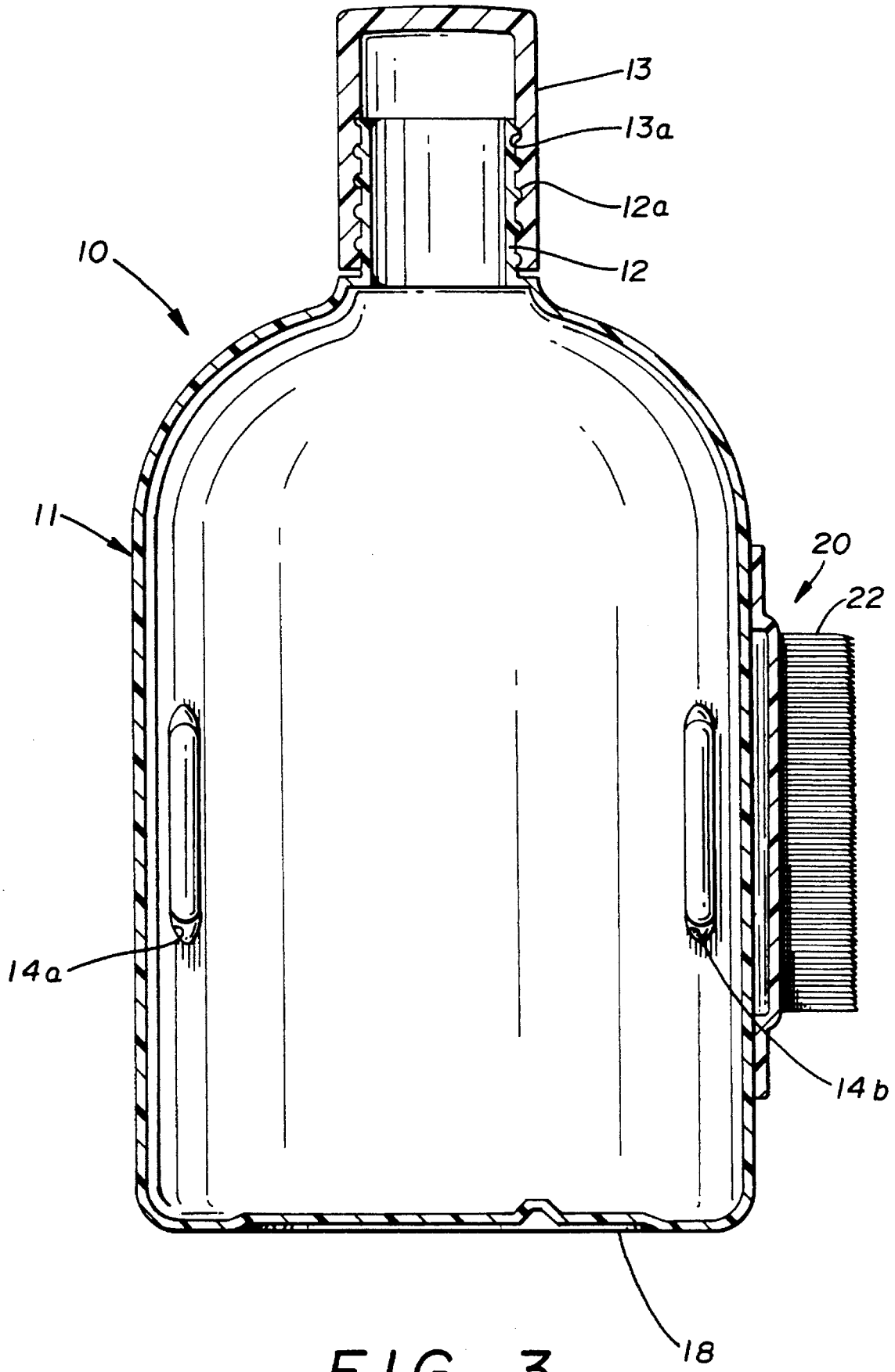
FIG. 3 is a sectional view thereof taken along the line 3—3 of FIG. 1.

It should first be noted that the container of the disclosed combination has been referred to herein, and will be referred to hereafter, as a container for soap or other cleaning substance intended for use on the human body. It is believed, however, that the invention is not necessarily limited to a container bearing that particular type of product but that the structural features of the invention lend themselves to use with containers bearing other contents. Turning then to FIGS. 1, 2, and 3 of the drawings, it will be noted that the container, generally indicated by the numeral 10, includes a body 11 and a neck 12. The neck 12 is threaded as at 12*a* and receives a cap 13 which is likewise threaded complementally at 13*a*.

In the form of the invention illustrated, the container 10 is of the type in which the cap 13 is removed and the contents are dispensed by simply tilting the container 10. As noted previously, however, some containers, particularly for soap or other cleaning materials, are fitted with a pump which is receivable on the neck of the container while others are squeeze bottles with flip-tops, and the present invention is intended to encompass containers embodying such designs as well.

Still referring to FIGS. 1, 2 and 3 of the drawings, it will be noted that the container body 11 includes front and rear walls 14 and 15 and opposed sidewalls 16 and 17. The container is essentially integral and forms a generally truncated elliptical shape when viewed from the bottom or in section. The aesthetics of the container are obviously subject to individual desires and one configuration only is illustrated in this application.

Still referring to FIGS. 1, 2 and 3, it will be noted that handle engaging depressions are disposed in the front and rear walls 14 and 15. With particular reference to FIGS. 2 and 3, it will be seen that the depressions in the front wall 14 are indicated by the numerals 14*a* and 14*b* and in the rear wall 15 by the numerals 15*a* and 15*b*. It will further be noted that these depressions are identical and are disposed in pairs close to the juncture between the front and rear walls 14 and 15 and sidewalls 16 and 17. While the invention has been illustrated as having two pairs of such depressions, it is to be understood that one pair could be used. However, for ease of manufacture and symmetrical appearance two may be the preferred embodiment.

It will also be noted, particularly from FIGS. 1 and 2 of the drawings, that the sidewalls and rear walls merge into each other smoothly so as to form a smooth and pleasing aesthetic appearance and also so as to provide for ease of gripping and handling.

Figure 4:
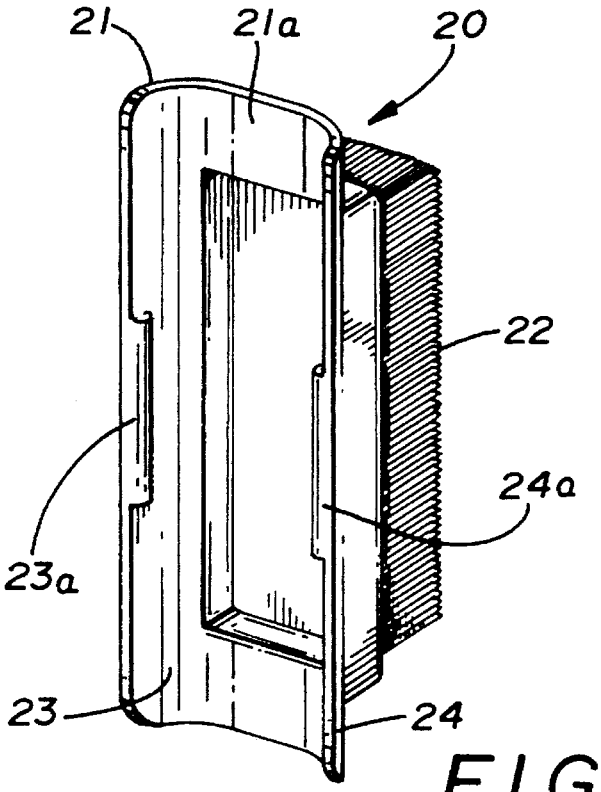
FIG. 4 is a perspective view of the applicator of the combination.

Turning next to FIG. 4 of the drawings, it will be noted that the applicator 20 has a handle 21 which is formed with a base 21*a* and edges 23 and 24. In the form of the invention illustrated, bristles 22 project from one side of the base 21*a* and the edges 23 and 24 project from the opposed edge thereof in a plane substantially normally to the plane of the base 21*a*.

Located about the midpoint of the edges 23 and 24 are container engaging ribs 23*a* and 24*a* which extend along at least a portion of the length of the edges and lie in a plane substantially parallel to that of base 21*a*.

It will also be noted from FIGS. 2 and 4 of the drawings that the configuration of the base 21*a* and the edges 23 and 24 is roughly complemental to the configuration of the combination of the front and rear walls 14 and 15 and the opposed sidewalls 16 and 17 so that when the handle 21 is affixed to the container 10, as shown in FIG. 2 for example, the configurations are substantially complemental and merge into each other, as can be clearly seen in FIG. 1 of the drawings thereby enhancing the aesthetics of the overall product.

In use or operation of the improved combination, it can be seen that the ribs 23*a* and 24*a* snap into the depressions 14*b* and 15*b* (see FIG. 2). Obviously, the handle 21 could be affixed to either set of depressions or, for that matter, two applicators 20 could be affixed to the container 10, although only one is illustrated in the drawings. In that regard, if two applicators were provided, they could be identical or could have bristles 22 of different configuration or texture. In any event, it is believed apparent that, in use, the applicator 20 can simply be snapped off the container 10, used and then returned to its place so that the container 10 and the applicator 20 remain together throughout the life thereof or, in other words, until the contents of the container 10 are expended.

FIG. 2 also illustrates that the bottom 18 of the container 10 has locating depressions 19 thereon which are intended to enable the container 10 to be properly oriented during the filling operation. Thus, during manufacture, and particularly during the decorating and filling operations, it is necessary to properly orient the container and these recesses, together with locating lugs on the machinery serve this purpose.

It is believed, therefore, that an improved container and applicator combination has been provided, as disclosed herein, which does not detract from the aesthetic appearance of the container when placed on the shelf in a retail store, for example, but which readily provides access to the applicator and makes it possible to maintain the applicator and the container as a unit when not in use and use which enhances the value to the purchaser.

While a full and complete description of the invention has been set forth in accordance with the dictates of the Patent statutes, modifications thereof may be made without departing from the spirit hereof or the scope of the appended claims.

Thus, it will be noted that no material has been specified for the elements of the combination nor has any manufacturing process been specified. As illustrated, the container and applicator are molded and preferably of a suitable plastic material. Such material is common for like components, such as the container and applicator, and has the added advantage of facilitating the snap fit of the applicator due to the inherent material resiliency of the material. However, the invention is not intended to be limited to any particular material or method of manufacture.

Also, while the applicator 20 which is illustrated takes the form of a brush having a handle 21*a* and bristles 22, it is believed that a different type of applicator could readily be substituted wherein, for example, the bristles could be replaced by some other feature such as an abrasive pad, etc.

What is claimed is:

1. A container and applicator combination comprising:

(a) a container having front and rear walls and integral, opposed sidewalls interconnecting said front and rear walls;

(b) at least one applicator including an elongate handle; and (c) means, carried by said front and rear walls of said container and said elongate handle of said applicator for releasably attaching said applicator to said container.

2. The combination of claim 1 wherein said applicator is a brush; and said elongate handle is releasably engagable with said container.

3. The combination of claim 2 wherein said handle has opposed, spaced apart edges projecting therefrom and extending throughout at least a portion of its length; and said edges are releasably engagable with said container.

4. The combination of claim 3 wherein said handle has a base; said opposed edges project from said base in a plane substantially normal to the plane of said base; and container engaging ribs are disposed along a portion of said edges for engagement with said container and project toward each other and substantially normal to the planes of said edges.

5. The combination of claim 4 wherein said container has at least one pair of handle engaging depressions disposed on the outer surface of said front and rear walls thereof adjacent one of said sidewalls.

6. The combination of claim 4 wherein said container has two pairs of handle engaging depressions disposed in said front and rear walls, one of said pairs of depressions adjacent each of said sidewalls.

7. The combination of claim 4 wherein said handle has a configuration complemental to the configuration of said sidewalls and said front and rear walls.

* * * * *